United States Patent [19]

Kassai

[11] Patent Number: 4,669,138

[45] Date of Patent: Jun. 2, 1987

[54] PLAYPEN

[75] Inventor: Kenzou Kassai, Osaka, Japan

[73] Assignee: Aprica Kassai Kabushikikaisha, Osaka, Japan

[21] Appl. No.: 876,264

[22] Filed: Jun. 19, 1986

[30] Foreign Application Priority Data

Jun. 28, 1985 [JP] Japan ..... 60-99818[U]
Sep. 3, 1985 [JP] Japan ..... 60-134959[U]

[51] Int. Cl.[4] ..... A47D 13/06
[52] U.S. Cl. ..... 5/99 C
[58] Field of Search ..... 5/99 R, 99 A, 99 B, 5/99 C; 52/65, 71; 256/25

[56] References Cited

U.S. PATENT DOCUMENTS 2,601,111 6/1952 Foster ..... 5/99 A

FOREIGN PATENT DOCUMENTS 807362 3/1969 Canada ..... 5/99 C

*Primary Examiner*—John E. Murtagh
*Attorney, Agent, or Firm*—W. G. Fasse; D. H. Kane, Jr.

[57] ABSTRACT

A playpen has a vertical pipe extending between first and second panels, an upper sleeve fixed to the first panel and receiving the upper end of the vertical pipe, a lower sleeve fixed to the first panel and receiving the lower end of the vertical pipe, elongated openings formed in the upper sleeve, an upper pin extending through the vertical pipe and the elongated openings, a locking lever turnable around the upper pin between first and second positions, a lower pin which interconnects the vertical pipe and the lower sleeve, an upper engaging member fixed to the second panel and disposed above the upper sleeve, a lower engaging member fixed to the second panel and disposed below the lower sleeve, and a distance defining member for defining the maximum distance between the upper and lower engaging members. The contact portions of the upper engaging member and the upper sleeve and the contact portions of the lower engaging member and the lower sleeve are formed with engaging raised and recessed portions, respectively, which are engageable with each other. When the locking lever is in the first position, relative turning movement between the first and second panels is allowed. When the locking lever is in the second position, relative turning movement between the first and second panels is inhibited.

5 Claims, 41 Drawing Figures

PLAYPEN

BACKGROUND OF THE INVENTION

1. Field of the Invention

This invention relates to a playpen which encloses a given space to provide a safe space for a baby or young child to play therein, and particularly to a playpen adapted to change the shape of the enclosed space.

2. Description of the Prior Art

Among playpens of this type is one comprising a plurality of panels for enclosing a given space, adjacent panels being turnably connected together. According to this playpen, an enclosed space of desired shape, such as square or octagon, can be obtained in accordance with the environment in which the playpen is placed; thus, it is convenient for use.

Generally, such playpens having adjacent panels turnably connected together, however, are not provided with means for inhibiting relative turning movement of adjacent panels. From the standpoint of safety, it is desirable that when a baby is playing in the playpen, the angle between adjacent panels be firmly fixed so that the shape of the enclosure does not change.

Some playpens use a spring force to resist relative turning movement between adjacent panels. In this type of playpens, if the spring force is increased, adjacent panels cannot be turn easily. On the other hand, if it is desired to turn adjacent panels to change the angle therebetween, a sufficient torque to overcome the spring force must be imparted, thus making the operation difficult. Further, in the case of such a construction requiring a great force to resist turning movement, wear in sliding parts increases, offering a problem that the life of the product is shortened.

SUMMARY OF THE INVENTION

Accordingly, an object of the invention is to provide a playpen wherein when a baby is playing in the playpen, turning movement between adjacent panels can be positively prevented, while when it is desired to change the shape of the enclosure, a less force is required to turn adjacent panels.

A playpen according to the invention comprises a plurality of panels for enclosing a given space, adjacent panels being turnably connected together, and is characterized by the following.

Between first and second panels at predetermined positions, a vertical pipe extending vertically along their boundary line is disposed. An upper sleeve is attached to the upper end of said vertical pipe and a lower sleeve to the lower end. The upper and lower sleeves are fixed to the upper and lower panel, respectively.

The upper sleeve is formed with a vertically extending elongated opening. An upper pin is provided which extends through said elongated opening and said vertical pipe. Further, a locking lever is attached to said upper pin. The locking lever is turnable around the axis of the upper pin between a first position and a second position. Further, a lower pin is provided which connects the vertical pipe and the lower sleeve to enable them to turn in a unit.

When the locking lever is in the first position, the upper sleeve has been displaced downward along the vertical pipe. Further, when the locking lever is in the second position, the upper sleeve has been pushed up by said locking lever and thus displaced upward along the vertical pipe.

An upper engaging member is disposed on the upper sleeve, and a lower engaging sleeve is disposed on the lower sleeve. The upper and lower engaging members are fixed to the upper and lower ends of the second panel, respectively. Further, a distance defining member is provided which defines the maximum distance by which the upper and lower engaging members can be separated from each other.

The contact portions of the upper engaging member and upper sleeve and the contact portions of the lower engaging member and lower sleeve are respectively formed with engaging raised and recessed portions which are engageable with each other.

And when the locking lever is in the first position, the upper engaging member and upper sleeve, and the lower engaging member and lower sleeve are respectively movable away from each other to a position where the engaging raised and recessed portions can be disengaged from each other. Therefore, relative turning movement between the first and second panels is allowed.

When the locking lever is in the second position, the upper and lower engaging members having the distance therebetween defined by the distance defining member are contacted with the upper and lower sleeves, respectively. Therefore, the state of engagement between the engaging raised and recessed portions is maintained, thus inhibiting relative turning movement between the first and second panels.

As described above, according to this invention, relative turning movement between the first and second panels which are at predetermined positions can be reliably inhibited by turning the locking lever to the second position. Therefore, the present playpen is superior in safety performance, enabling a baby to play on the safe side. Further, the first and second panels can be turned with less force when the locking level is turned to the first position; thus, the turning operation is easy and wear in sliding parts can be reduced.

These object and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
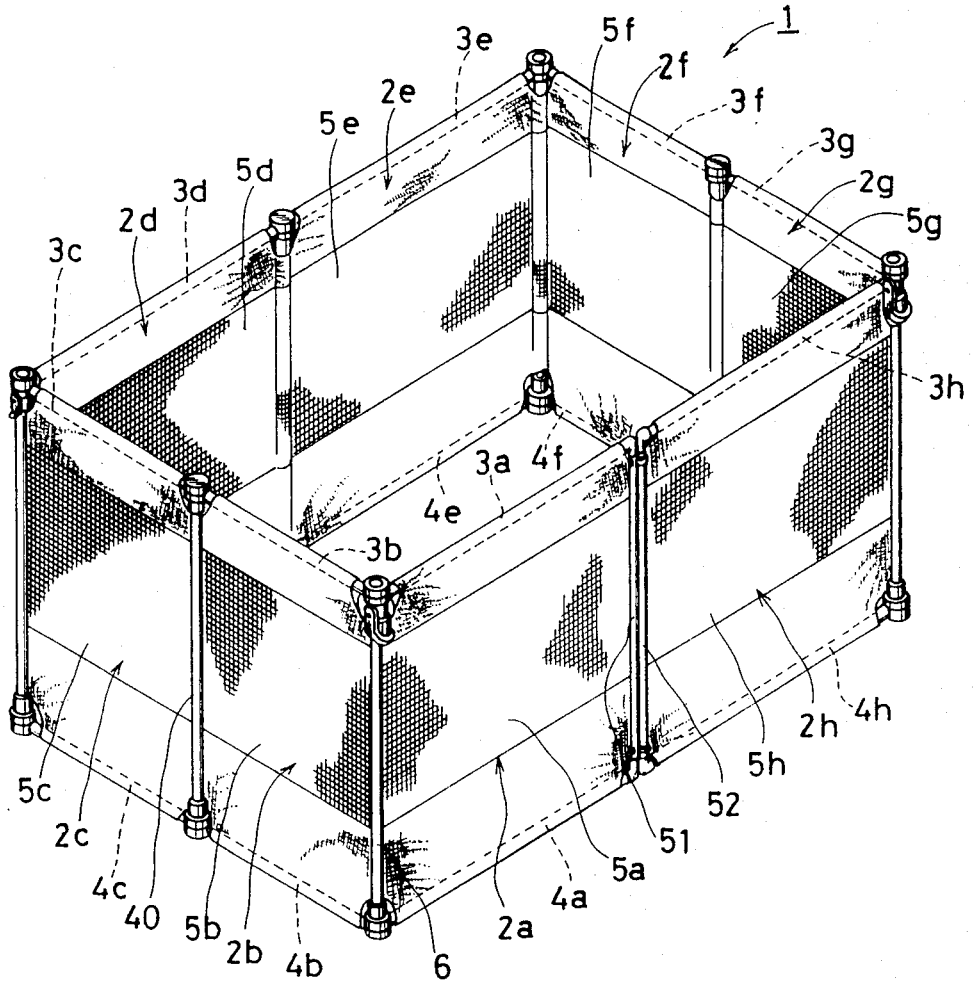
FIG. 1 is a perspective view of a first embodiment of this invention.
Figure 2:
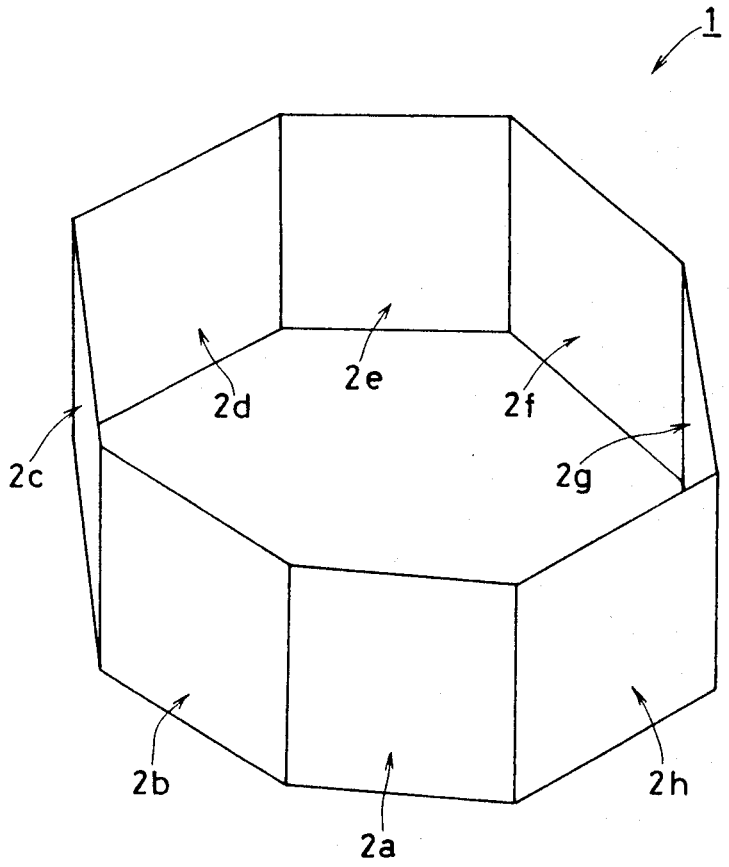
FIG. 2 is a diagrammatic view showing an example of a state in which the shape of the enclosure provided by the playpen of FIG. 1 has been changed.

FIG. 1 shows an embodiment of this invention. The illustrated playpen 1 comprises a plurality of panels 2*a*, 2*b*, 2*c*, 2*d*, 2*e*, 2*f*, 2*g* and 2*h* to enclose a given space, adjacent panels being turnably connected together. The panels 2*a*, 2*b* . . . 2*h*, which are square or rectangular as shown, are composed of upper frames 3*a*, 3*b* . . . 3*h*, lower frames 4*a*, 4*b* . . . 4*h*, and nets 5*a*, 5*b* . . . 5*h* spread between the opposite frames, respectively Adjacent panels 2*a*, 2*b* . . . 2*h* are turnable relative to each other so that the shape of the enclosure provided by the playpen can be variously changed. For example, FIG. 1 shows a square enclosure but an octagonal enclosure may be obtained as shown in FIG. 2.

Vertically extending vertical pipes are disposed along boundary lines between adjacent panels 2*a*, 2*b* . . . 2*h*. Of the 8 panels shown, let the panel 2*a* be the first panel and the panel 2*b* adjacent this one be the second panel. And the reference numeral 6 is given to the vertical pipe which is disposed along the boundary line between the first and second panels 2*a* and 2*b*.

Figure 3:
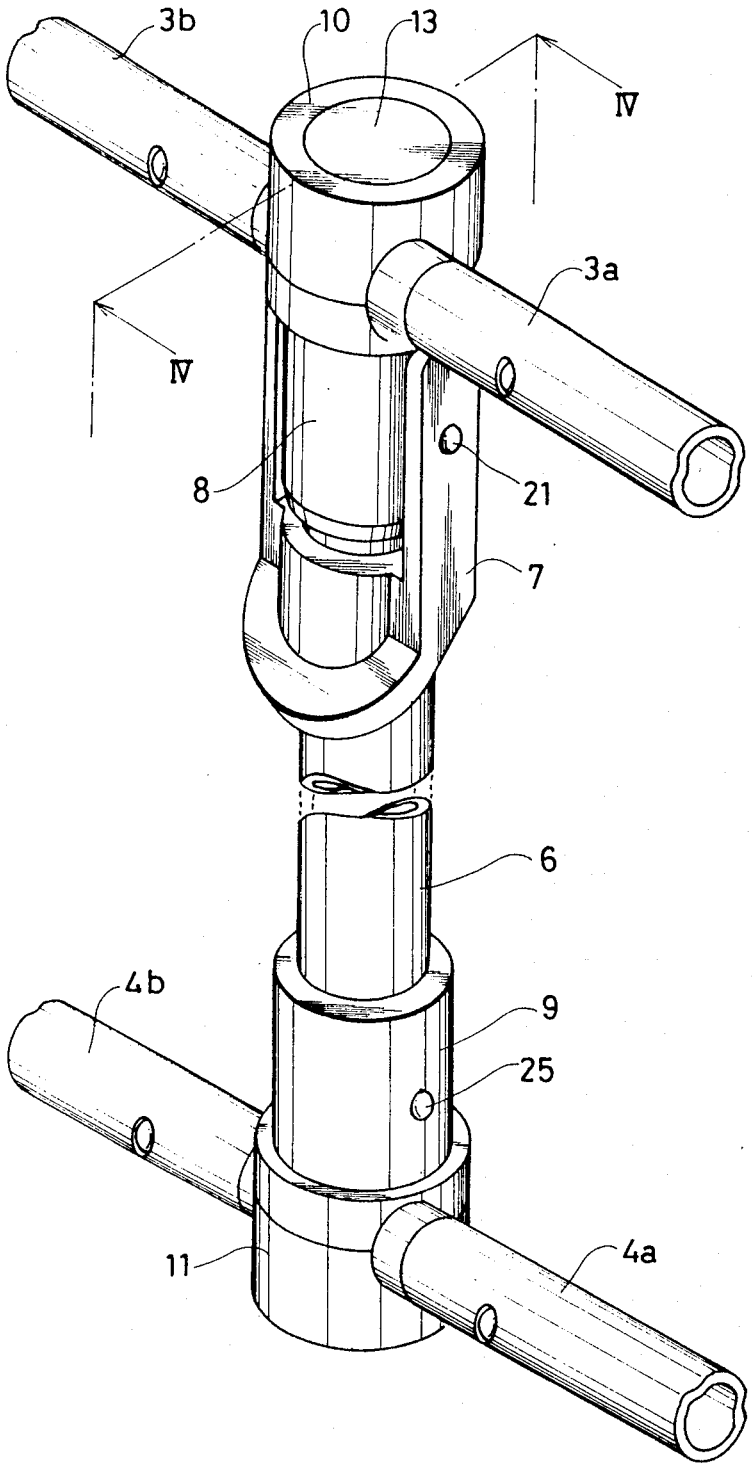
FIG. 3 is a perspective view showing a connecting portion between a first panel 2*a* and a second panel 2*b* shown in FIG. 1.
Figure 4:
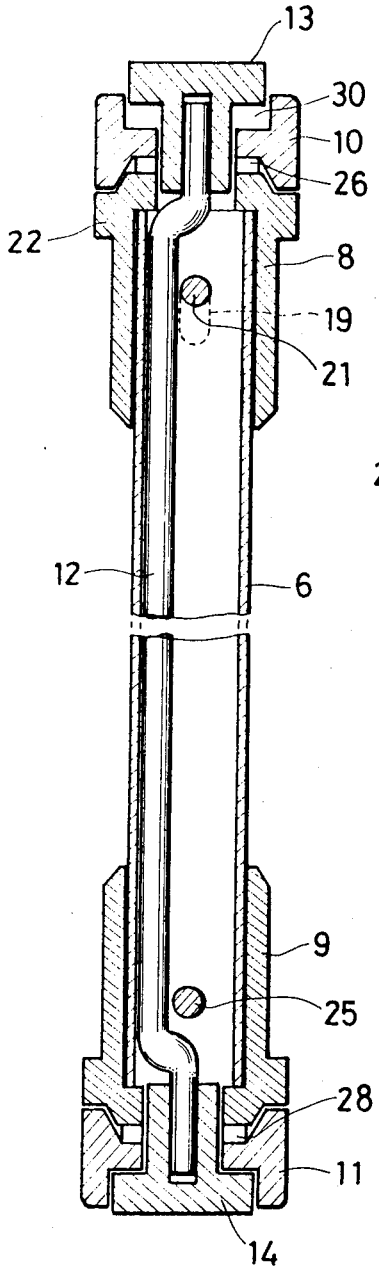
FIG. 4 is a sectional view taken along the plane IV—IV in FIG. 3.
Figure 5:
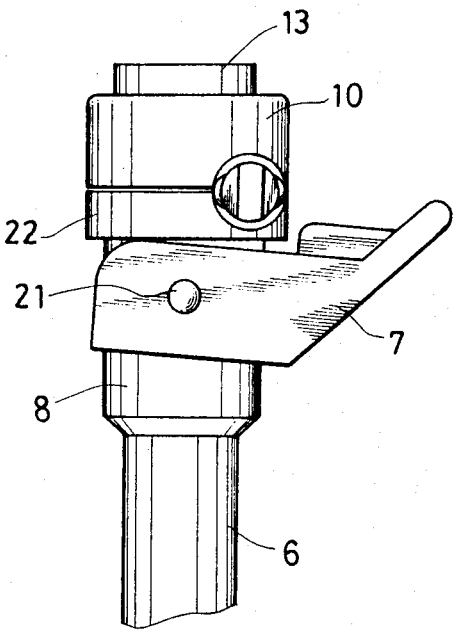
FIG. 5 is a view showing the state which is established by turning a locking lever 7 from the state of FIG. 3 in a predetermined direction.

FIG. 3 is a perspective view showing a connecting portion between the first and second panels 2*a* and 2*b*, with nets 5*a* and 5*b* being omitted from the illustration for the sake of convenience. FIG. 4 is a sectional view taken along the plane IV—IV in FIG. 3. FIG. 5 is a view showing the state which is established by turning a locking lever 7, to be later described, from the state of FIG. 3 in a predetermined direction.

Referring to these figures, an upper sleeve 8 is fitted on the upper end of the vertical pipe 6 and a lower sleeve 9 on the lower end. The upper and lower sleeves 8 and 9 are fixedly attached to the upper and lower frames 3*a* and 4*a* of the first panel 2*a*, respectively. An upper engaging member 10 is disposed on the upper sleeve 8 and a lower engaging member 11 on the lower sleeve 9. The upper and lower engaging members 10 and 11 are fixedly attached to the upper and lower frames 3*b* and 4*b* of the second panel 2*b*. Disposed inside the vertical pipe 6 is an upwardly extending rod 12. The upper and lower ends of this rod 12 have upper and lower flange members 13 and 14 fixed thereto, respectively.

Figure 13:
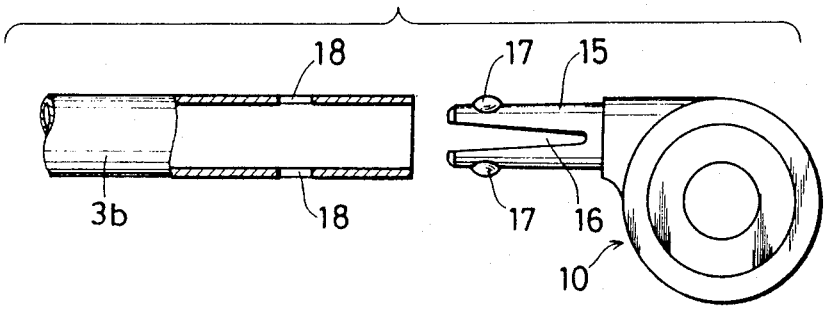
FIG. 13 is a view for explaining the connecting construction between the upper engaging member 10 and the upper frame 3*b* of the second panel 2*b;*
Figure 14:
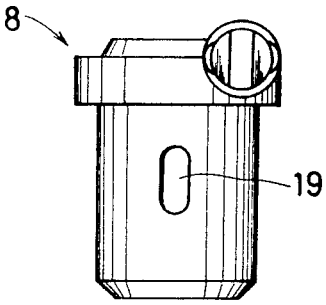
FIG. 14 is a view of the upper sleeve 8.
Figure 16:
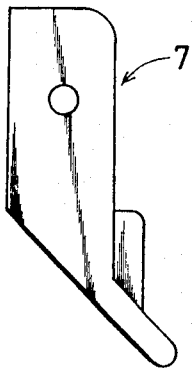
FIG. 16 is a view of a locking lever 7.
Figure 15:
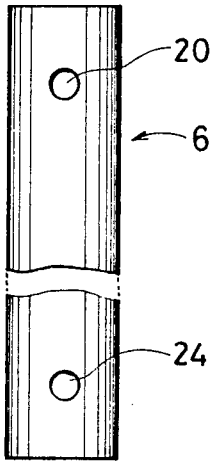
FIG. 15 is a view of a vertical pipe 6 shown in FIG. 4.

FIGS. 6 through 12 show the upper flange member 13, upper engaging member 10, upper sleeve 8, rod 12, lower sleeve 9, lower engaging member 11 and lower flange member 14, respectively. In addition, FIGS. 6 through 12 are taken in a direction parallel to the plane IV—IV in FIG. 3. FIG. 13 is a plan view for explaining the connecting construction between the upper engaging member 10 and the upper frame 3*b* of the second panel 2*b*. FIGS. 14 through 16 are views showing the upper sleeve 8, vertical pipe 6 and locking lever 7, respectively, taken in a direction orthogonal to the plane IV—IV in FIG. 3.

As described above, the upper and lower sleeves 8 and 9 are fixed to the first panel 2*a*, while the upper and lower engaging members 10 and 11 are fixed to the second panel 2*b*. The manner of fixing is the same for all said four elements; therefore, representatively, the fixing construction between the upper engaging member 10 and the upper frame 3*b* of the second panel 2*b* will now be described. Referring to FIG. 13, the upper engaging member 10 has a cylindrical portion 15 centrally formed with a cut 16. The cylindrical portion 15 develops some degree of elasticity owing to the presence of the cut 16. That is, the cylindrical portion 15 is deformable in the direction which cause a reduction in width of the cut 16, and when so deformed it develops a restoring force. Further, as shown, the outer peripheral surface of the cylindrical portion 15 is provided with 2 projections 17. The upper frame 3*b* of the second panel 2*b* is in the form of a tubular member having substantially the same diameter as that of the cylindrical portion 15 and has 2 holes 18 adapted to receive the projections 17. Thus, when the cylindrical portion 15 is inserted from the state shown in FIG. 13 into the upper frame 3*b* by deforming it to reduce the width of the cut 16, the projections 17 will finally engage the holes 18, so that the upper engaging member 10 and the upper frame 3*b* can be fixed together.

Referring to FIGS. 4, 8, 14 and 15, the upper sleeve 8 is formed with vertically extending elongated openings 19. Correspondingly thereto, the vertical pipe 6 is formed with round holes 20. The upper sleeve 8 is attached to the vertical pipe 6 by an upper pin 21 extending through said round holes 20 and elongated openings 19. The upper sleeve 8 is vertically movable on the vertical pipe 6 in the range in which the upper pin 21 is movable in the elongated openings 19. In the state shown in FIG. 4, the upper sleeve 8 is in its lowermost position. The length of the upper pin 21 is such that its opposite ends project beyond the outer surface of the upper sleeve 8. Mounted on these projecting portions is a locking lever 7 shown in FIGS. 5 and 16. The locking lever 7 is turnable around the axi.s of the upper pin 21 between a first position shown in FIG. 5 and a second position shown in FIG. 19.

Figure 19:
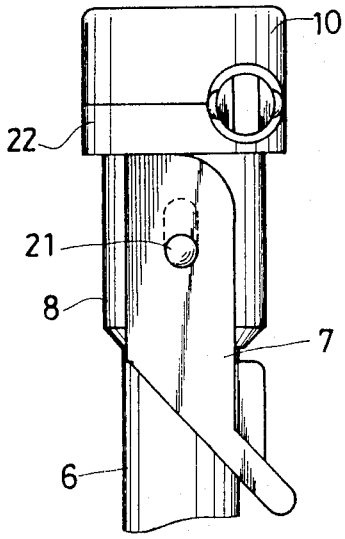
FIG. 19 is a view showing a state assumed by the locking lever 7 when the latter is turned from its first position shown in FIG. 5 to its second position.

As shown in FIGS. 5 and 19, the upper sleeve 8 has a bulging portion 22 capable of abutting against the locking lever 7. Therefore, if the locking lever 7 is turned from the first position shown in FIG. 5 to the second position shown in FIG. 19, the upper sleeve 8 is pushed up for upward displacement by the locking lever 7. Since the upper engaging member 10 is placed on the upper sleeve 8, it is also displaced upward along with the upward displacement of the upper sleeve 8.

Figure 10:
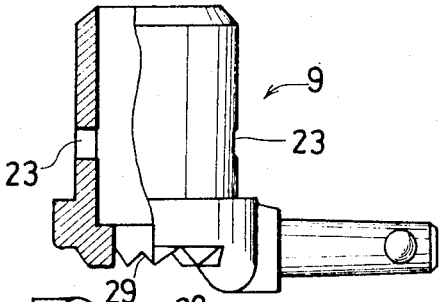
Figure 11:
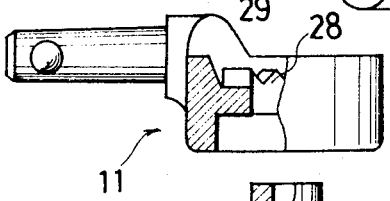

Referring to FIGS. 4, 10 and 15, the lower sleeve 9 is formed with round holes 23 and, correspondingly thereto, the lower end portion of the vertical pipe 6 is formed with round holes 24. The lower sleeve 9 is attached to the vertical pipe 6 by a lower pin 25 extending through said round holes 23 and 24.

Figure 7:
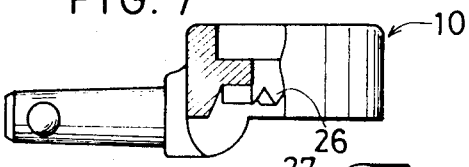
Figure 8:
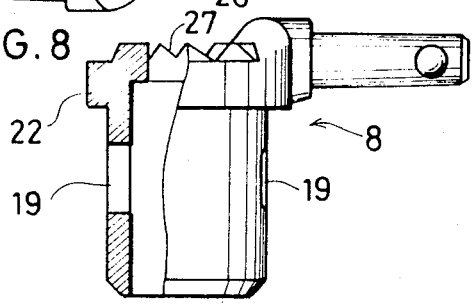

Referring to FIGS. 7 and 8, the contact portions of the upper engaging member 10 and upper sleeve 8 are formed with engaging raised and recessed portions 26 and 27, respectively, which are engageable with each other. The engaging raised and recessed portions 26 and 27 are in the form of a plurality of V-shaped ridges interconnected in annular form. In the state shown in FIGS. 4 and 5, the engaging raised and recessed portions 26 and 27 are engaged with each other. In this state, if torque is imparted to the upper engaging member 10, the engaging raised portions are moved on the inclined surfaces of the engaging recessed portions 27 until they reach the position they are disengaged therefrom. In other words, the upper engaging member 10 is displaced upward at the same time as it is rotated, thus cancelling the engagement between the engaging raised and recessed portions 26 and 27. In this manner, relative turning movement between the upper engaging member 10 and the upper sleeve 8 is allowed.

Similarly, the contact portions of the lower engaging member 11 and lower sleeve 9 are formed with engaging raised and recessed portions 28 and 29, respectively, which are engageable with each other. Since the action of the engaging raised and recessed portions 28 and 29 is the same as that of the engaging raised and recessed portions 26 and 27, a description thereof is omitted.

Figure 6:
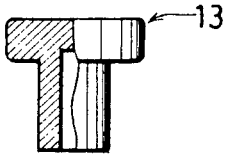
FIGS. 6, 7, 8, 9, 10, 11 and 12 are views showing an upper flange member 13, an upper engaging member 10, an upper sleeve 8, a rod 13, a lower sleeve 9, a lower engaging member 11, and a lower flange member 14, respectively, shown in FIG. 4.
Figure 9:
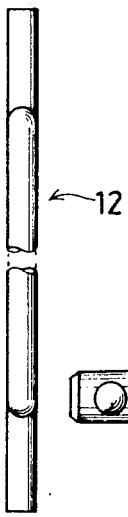
Figure 12:
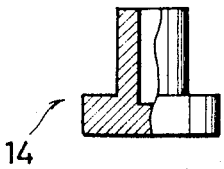

The upper flange member 13, rod 12 and lower flange member 14 shown in FIGS. 6, 9 and 12, respectively, serve to define the maximum distance by which the upper and lower engaging member 10 and 11 can be separated from each other. That is, referring to FIG. 4, the upper flange member 13 fixed on the upper end of the rod 12 is shaped so that it can abut against the upper surface of the upper engaging member 10. In the state shown in FIG. 4, a clearance 30 is defined between the upper flange member 13 and the upper engaging member 10. Therefore, the upper engaging member 10 can be displaced upward by an amount equal to the clearance 30. The lower flange member 14 fixed on the lower end portion of the rod 12 is shaped so that it can abut against the lower surface of the lower engaging member 11.

Figure 17:
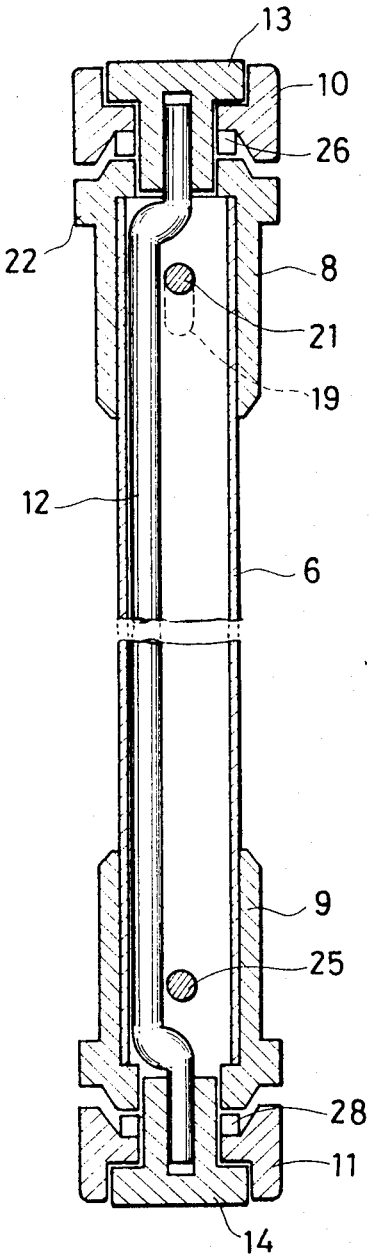
FIG. 17 is a sectional view showing the upper engaging member 10 and upper sleeve 8 disengaged from each other and the lower engaging member 11 and lower sleeve 9 disengaged from each other.

As shown in FIG. 5, when the locking lever 7 is in the first position, relative turning movement between the first and second panels 2*a* and 2*b* is allowed. For example, suppose that rotative force is imparted to the second panel 2*a*. That is, suppose that rotative force is imparted to the upper and lower sleeves 8 and 9. Then, the lower sleeve 9 is displaced upward while rotating, thus cancelling its engagement with the lower engaging member 11. In accordance with the upward displacement of the lower sleeve 9, the vertical pipe and upper sleeve 8 are also displaced upward, with the upper sleeve 8 pushing up the upper engaging member 10. As a result, the engagement between the upper engaging member 10 and the upper sleeve 8 is also canceled. This state is shown in FIG. 17. In this manner, the first panel 2*a* can be turned to a desired position.

Figure 20:
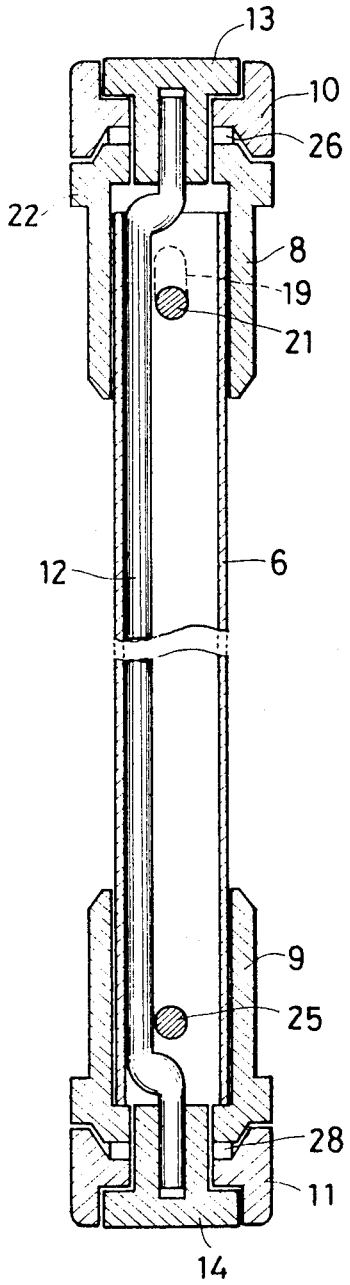
FIG. 20 is a sectional view showing a state established by turning the locking lever 7 from the state shown in FIG. 4 to its second position.
Figure 18:
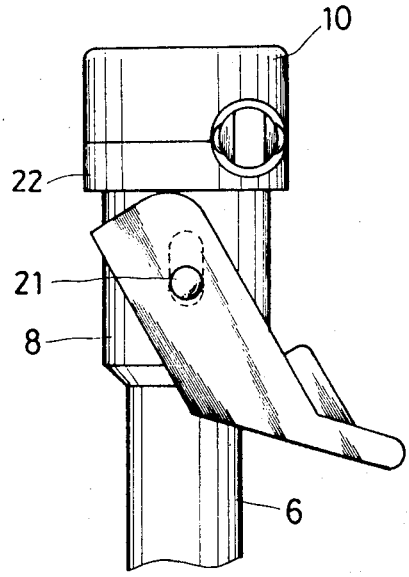
FIG. 18 is a view showing an intermediate state assumed by the locking lever 7 when the latter is turned from the state shown in FIG. 5.

Consideration will now be given to the case where after the first panel 2*a* has been turned to a desired position, it is desired to fix it in that state. Before it is fixed, the state is as shown in FIGS. 4 and 5. From this state, the locking lever 7 is turned to the second position shown in FIG. 19. FIG. 18 shows an intermediate state assumed by the locking lever 7 during its turning movement. With the turning movement of the locking lever 7, the upper sleeve 8 and upper engaging member 10 are pushed up for upward displacement by the locking lever 7. Finally, the state shown in FIG. 20 is established. In the state shown in FIG. 20, there is no clearance between the upper engaging member 10 and the upper flange 13, with the result that the upper flange member 10 cannot be displaced upward from the state shown in FIG. 20. In this manner, the lower sleeve 9 and the lower engaging member 11 are sandwiched between the vertical pipe 6 and the lower flange member 14, so that their engagement cannot be cancelled. Further, since the vertical pipe 6 is connected to the locking lever 7 by the upper pin 12, it cannot be displaced upward. In this manner, the lower sleeve 9 and the lower engaging member 11 is sandwiched between the vertical pipe 6 and the lower flange member 14, so that their engagement cannot be canceled As is clear from the description given above, when the locking lever 7 is in the second position shown in FIGS. 3 and 19, relative turning movement between the first and second panels 2*a* and 2*b* is reliably inhibited.

On the other hand, if the locking lever 7 is turned to the first position shown in FIG. 5, the first and second panels 2*a* and 2*b* can be easily turned with less force.

In the above embodiment, the upper flange member 13, the rod 12 and the lower flange member 14 have been employed as distance defining members for defining the maximum distance by which the upper and lower engaging members 10 and 11 can be separated from each other. However, as a modification, there is a case where such elements are not employed. For example, if the arrangement is such that the distance between the upper and lower frames 3*b* and 4*b* of the second panel 2*b* is maintained constant all the time, then the distance between the upper and lower engaging members 10 and 11 fixed to the upper and lower ends of the second panel 2*b* is also constant. In that case, when the locking lever 7 is in the position shown in FIG. 5, a clearance is defined between the upper engaging member 10 and the upper sleeve 8.

Referring to FIG. 1, the playpen 1 shown has 8 panels 2*a*, 2*b* . . . 2*h*, and a vertically extending vertical pipe is disposed along each boundary line between adjacent panels. All these vertical pipes may each be provided with means, such as described above, for inhibiting relative turning movement between adjacent panels. However, such an arrangement is not absolutely necessary, and only those vertical pipes which are disposed at suitable positions may be provided with the aforesaid turning movement inhibiting means. For example, in the playpen 1 shown, vertical pipes which are disposed at the corners of the square may be provided with the turning movement inhibiting means. As for the other vertical pipes disposed at other places, for example, a vertical pipe 40 disposed between the second and third panels 2*b* and 2*c* is designed to suppress relative turning movement between panels. This will now be described with reference to FIGS. 21 and 22.

A vertically extending vertical pipe 40 is disposed between the second and third panels 2*b* and 2*c* along the boundary line therebetween. The vertical pipe 40 has an upper sleeve 41 fitted on the upper end thereof and a lower sleeve 42 fitted on the lower end thereof. The upper and lower sleeves 41 and 42 are fixedly attached to the upper and lower frames 3*c* and 4*c* of the third panel 2*c*, respectively. Further, as shown, an upper engaging member 44 is placed on the upper sleeve 41 and a lower engaging member 44 on the lower sleeve 42. The upper and lower engaging members 43 and 44 are fixedly attached to the upper and lower frames 3*b* and 4*b* of the second panel 2*b*. Further, as in the case of the upper and lower sleeves 8 and 9 and upper and lower engaging members 10 and 11, the contact portions of the upper engaging member 43 and upper sleeve 41 and the contact portions of the lower engaging member 44 and lower sleeve 42 are formed with engaging raised and recessed portions, respectively, which are engageable with each other.

An upper flange member 4 comprising a stem portion extending through the upper engaging member 43 and upper sleeve 41 and a head portion positioned above the upper engaging member 43 is attached to the vertical pipe 40 by a pin 47. The pin 47 serves to interconnect the vertical pipe 40 and the upper sleeve 41. A clearance is defined between the head portion of the upper flange member 45 and the upper engaging member 43, and a spring 49 is disposed in said clearance. The spring 49 urges the upper engaging member 43 downward all the time. In other words, it acts to suppress relative turning movement between the upper engaging member 43 and the upper sleeve 41.

Similarly, a lower flange member 46 comprising a stem portion extending through the lower engaging member 44 and lower sleeve 42 and a head portion positioned below the lower engaging member 44 is attached to the vertical pipe 40 by a pin 48. The pin 48 serves to interconnect the vertical pipe 40 and the lower sleeve 42. A clearance is defined between the head portion of the lower flange member 46 and the upper engaging member 44, and a spring 50 is disposed in said clearance. The spring 50 urges the lower engaging member 44 upward all the time. In other words, it acts to suppress relative turning movement between the lower engaging member 44 and the lower sleeve 42.

Figure 21:
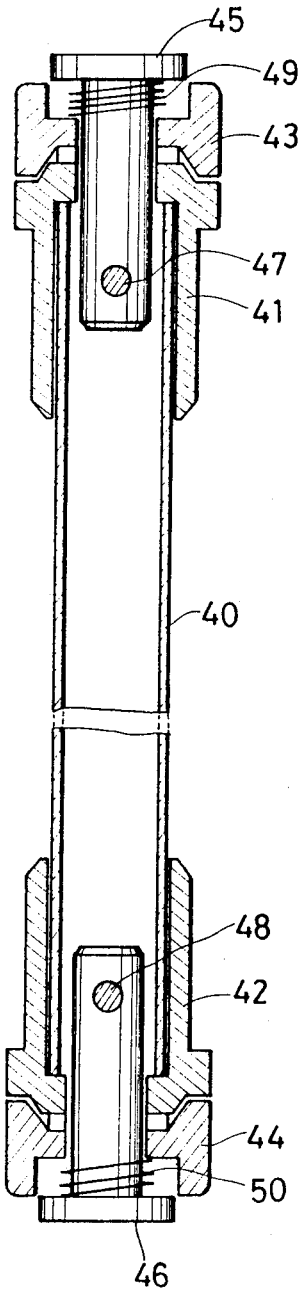
FIG. 21 is a sectional view showing a connecting portion between second and third panels 2*b* and 2*c* shown in FIG. 1.
Figure 22:
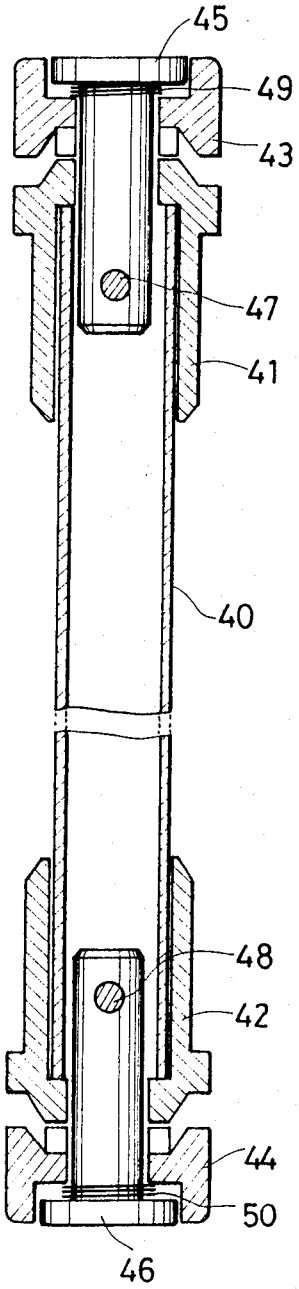
FIG. 22 is a sectional view showing a state established by turning the second panel 2*b* from the state shown in FIG. 21.

Suppose that the second panel 2*b* is operated for turning movement from the state shown in FIG. 21. Then, the upper and lower engaging members 43 and 44 are rotated and at the same time displaced upward and downward, as shown in FIG. 22, against the forces of the spring 49 and 50, respectively, whereby their respective engagement with the upper and lower sleeves 41 and 42 is cancelled. In this manner, relative turning movement between the second and third panels 2*b* and 2*c* is allowed.

Figure 23:
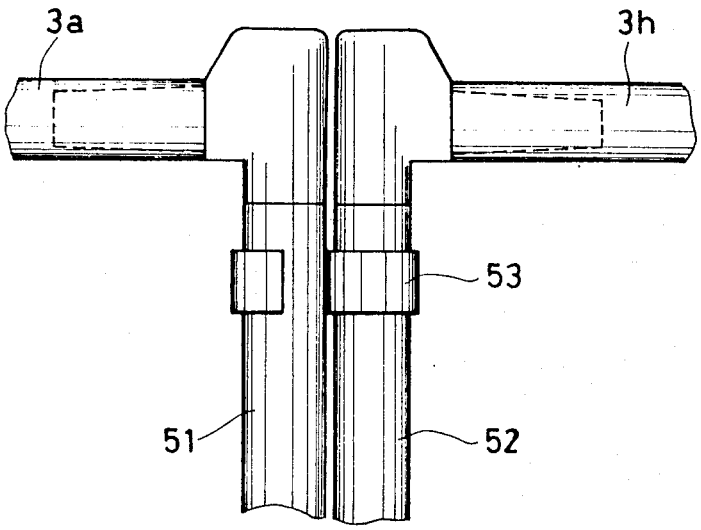
FIG. 23 is a view showing a connecting portion between the panels 2*a* and 2*b* shown in FIG. 1.
Figure 24:
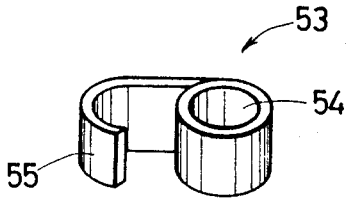
FIG. 24 is a perspective view of a connector 53 shown in FIG. 23.

Referring again to FIG. 1, the illustrated playpen 1 is arranged so that the first panel 2*a* and a panel 2*h* adjoining thereto are separable from each other. This arrangement will now be described with reference to FIGS. 23 and 24 as well as FIG. 1. Two vertically extending vertical rods 51 and 52 are disposed in the boundary portion between the panels 2*a* and 2*h*. One vertical rod 51 is fixed at its upper and lower ends to the upper and lower frames 3*a* and 4*a* of the panel 2*a*, respectively. The other vertical rod 52 is fixed at its upper and lower ends to the upper and lower frames 3*h* and 4*h* of the panel 2*h*, respectively. The vertical rods 51 and 52 are turnably connected together by a connector 53 shown in FIG. 24. The connector 53 has a tubular portion 54 for surrounding the vertical rod 52 and a hook portion 55 for clasping the vertical rod 51.

It has been previously pointed out that there is another manner of defining the maximum distance by which the upper and lower engaging members 10 and 11 can be separated from each another. A playpen which employs other form of distance defining means than the one described in the preceding embodiment will now be described.

Figure 25:
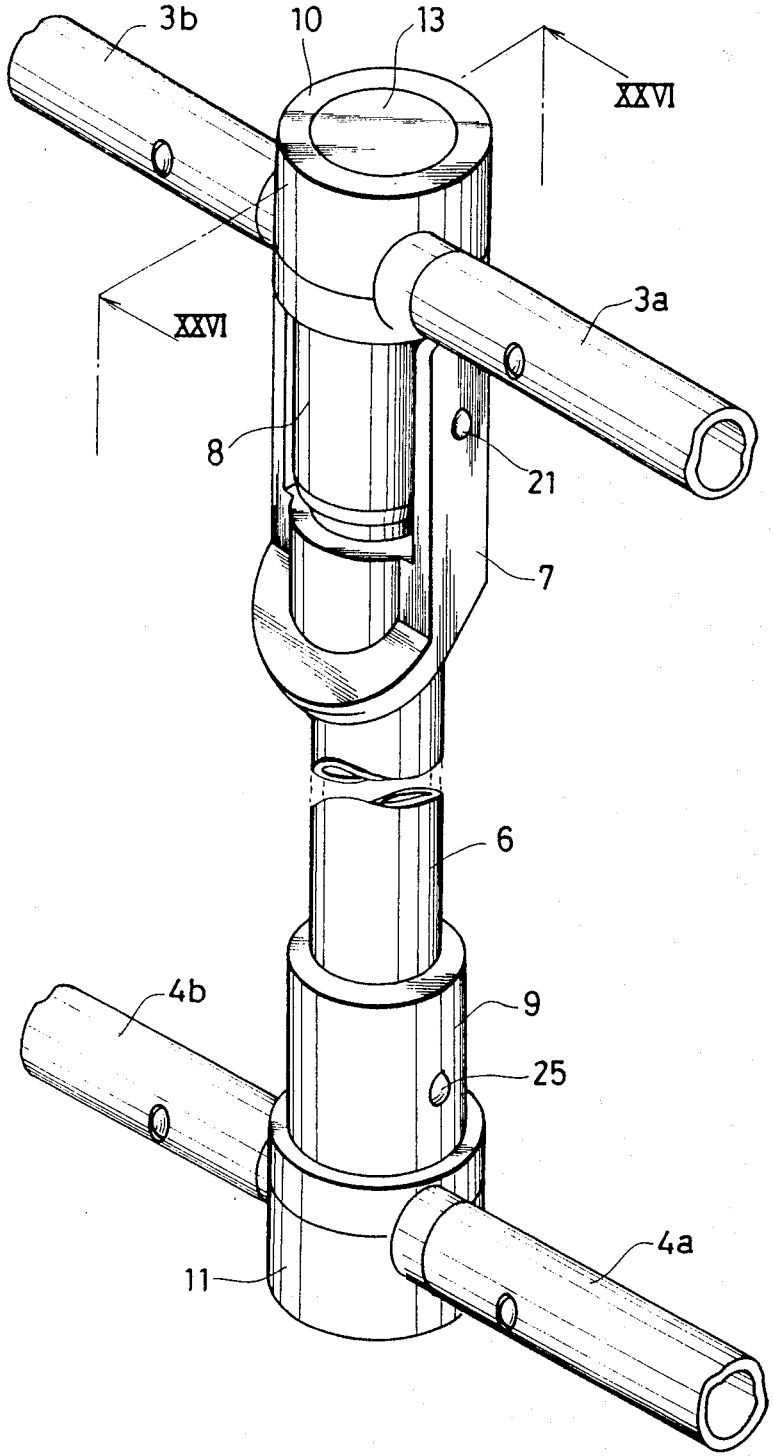
FIG. 25 is a perspective view of another form of a connecting portion between the first and second panels 2*a* and 2*b* shown in FIG. 1.
Figure 26:
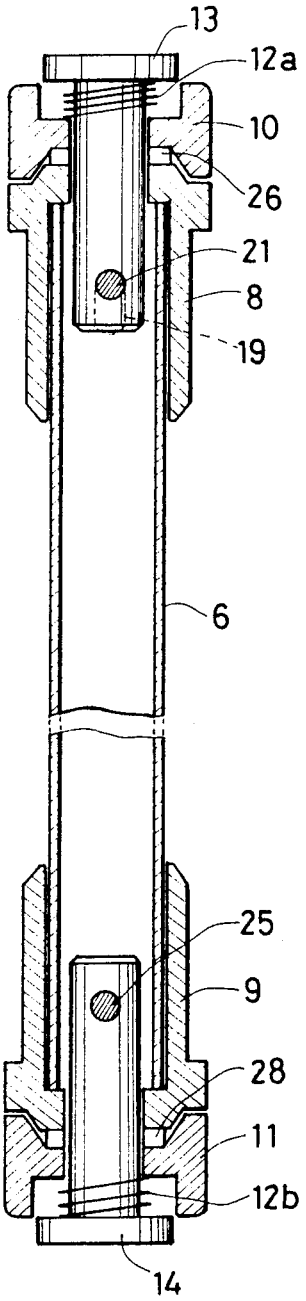
FIG. 26 is an end view taken along the plane XXVI—XXVI in FIG. 25.
Figure 27:
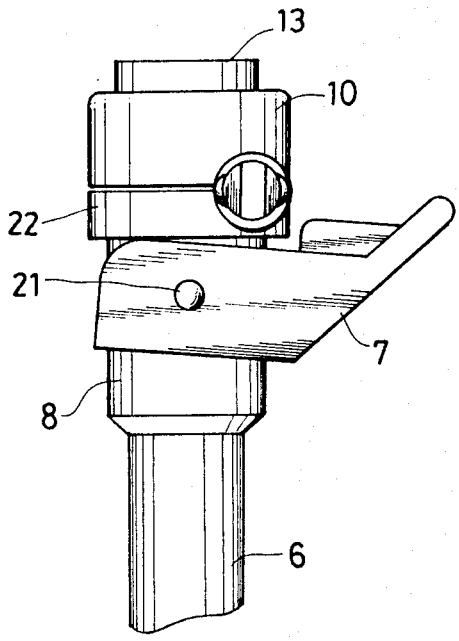
FIG. 27 is a view showing a state established by turning the locking lever 7 in a predetermined direction from the state of FIG. 25.
Figure 28:
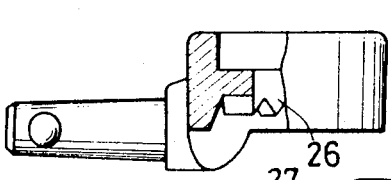
FIGS. 28, 29, 30 and 31 are views showing an upper engaging member 10, an upper sleeve 8, a lower sleeve 9, and a lower engaging member 11, respectively.
Figure 29:
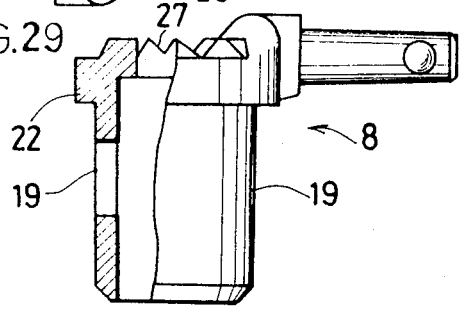

FIG. 25 is a perspective view of another form of a connecting portion between the first and second panels 2*a* and 2*b*, the nets 5*a* and 5*b* being omitted from the illustration. Viewed externally, there is no difference between what is shown in FIGS. 3 and 25. FIG. 26 is a sectional view taken along the plane XXVI—XXVI in FIG. 25. FIG. 27 is a view showing a state established by turning a locking lever 7 to be later described in a predetermined direction from the state of FIG. 25.

In addition, in FIGS. 11 through 41, like reference characters indicate like or corresponding elements.

Referring to these figures, an upper sleeve 8 is fitted on the upper end of the vertical pipe 6 and a lower sleeve 9 on the lower end. The upper and lower sleeves 8 and 9 are fixedly attached to the upper and lower frames 3*a* and 4*a* of the first panel 2*a*, respectively. An upper engaging member 10 is disposed on the upper sleeve 8 and a lower engaging member 11 on the lower sleeve 9. The upper and lower engaging members 10 and 11 are fixedly attached to the upper and lower frames 3b and 4b of the second panel 2b.

As shown in FIG. 26, there are installed an upper flange member 13 extending through the upper engaging member 10 and through the upper sleeve 8, and a lower flange member 14 extending through the lower engaging member 11 and through the lower sleeve 9. The upper flange member 13 has a flange portion positioned above the upper engaging member 10 and is fixedly attached at its lower end portion to the upper end of the vertical pipe 6 by an upper pin 21. The lower flange member 14 has a flange portion positioned below the lower engaging member 11 and is fixedly attached at its upper end portion to the lower end of the vertical pipe 6 by a lower pin 25. A clearance is defined between the flange portion of the upper flange member 13 and the upper engaging member 10 and a spring 12a is disposed in said clearance. The spring 12a urges the upper engaging member 10 downward all the time. Similarly, a clearance is defined between the flange portion of the lower flange member 14 and the lower engaging member 11 and a spring 12b is disposed in said clearance. The spring 12b urges the lower engaging member 11 downward all the time.

Figure 32:
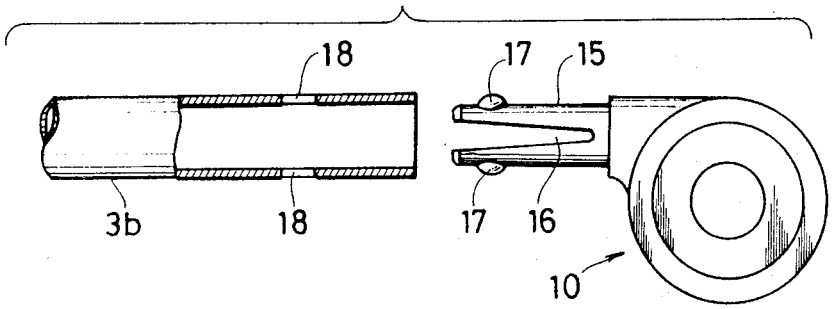
FIG. 32 is a view for explaining the connecting construction between the upper engaging member 10 and the upper frame 3*b* of the second panel 2*b;*
Figure 33:
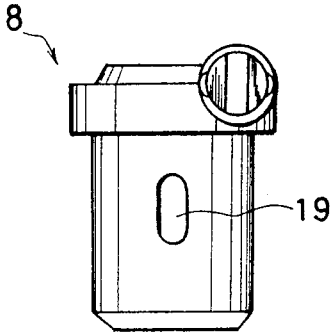
FIG. 33 is a view of the upper sleeve 8.
Figure 35:
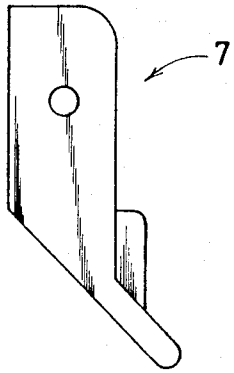
FIG. 35 is a view of a locking lever 7.
Figure 34:
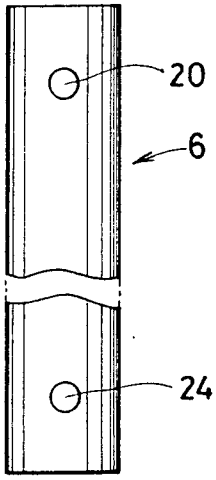
FIG. 34 is a view of a vertical pipe 6 shown in FIG. 26.

FIGS. 28 through 31 show the upper engaging member 10, the upper sleeve 8, the lower sleeve 9 and the lower engaging member 11, respectively. In addition, FIGS. 28 through 31 are views taken in a direction parallel to the plane XXVI—XXVI in FIG. 25. FIG. 32 is a plan view for explaining the connecting construction between the upper engaging member 10 and the upper frame 3b of the second panel 2b. FIGS. 33 through 35 are views showing the upper sleeve 8, the vertical pipe 6 and the locking lever 7, respectively, taken in a direction orthogonal to the plane XXVI—XXVI in FIG. 25.

As described above, the upper and lower sleeves 8 and 9 are fixed to the first panel 2a, while the upper and lower engaging members 10 and 11 are fixed to the second panel 2b. The manner of fixing is the same for all said four elements; therefore, representatively, the fixing construction between the upper engaging member 10 and the upper frame 3b of the second panel 2b will now be described. Referring to FIG. 32, the upper engaging member 10 has a cylindrical portion 15 centrally formed with a cut 16. The cylindrical portion 15 develops some degree of elastically owing to the presence of the cut 16. That is, the cylindrical portion 15 is deformable in the direction which causes a reduction in the width of the cut 16, and when so deformed it develops a restoring force. Further, as shown, the outer peripheral surface of the cylindrical portion 15 is provided with 2 projections 17. The upper frame 3b of the second panel 2b is in the form of a tubular member having substantially the same diameter as that of the cylindrical portion 15 and has 2 holes 18 adapted to receive the projections 17. Thus, when the cylindrical portion 15 is inserted from the state shown in FIG. 32 into the upper frame 3b by deforming it to reduce the width of the cut 16, the projections 17 will finally engage the holes 18, so that the upper engaging member 10 and the upper frame 3b can be fixed together.

Referring to FIGS. 26, 29, 33 and 34, the upper sleeve 8 is formed with vertically extending elongated openings 19. Correspondingly thereto, the vertical pipe 6 is formed with round holes 20. The upper sleeve 8 is attached to the vertical pipe 6 by an upper pin 21 extending through said round holes 20 and elongated openings 19. The upper sleeve 8 is vertically movable on the vertical pipe 6 in the same range as the upper pin 21 is movable in the elongated openings 19. In the state shown in FIG. 26, the upper sleeve 8 is in its lowermost position. The length of the upper pin 21 is such that its opposite ends project beyond the outer surface of the upper sleeve 8. Mounted on these projecting portions is a locking lever 7 shown in FIGS. 27 and 35. The locking lever 7 is turnable around the axis of the upper pin 21 between a first position shown in FIG. 27 and a second position shown in FIG. 38.

Figure 38:
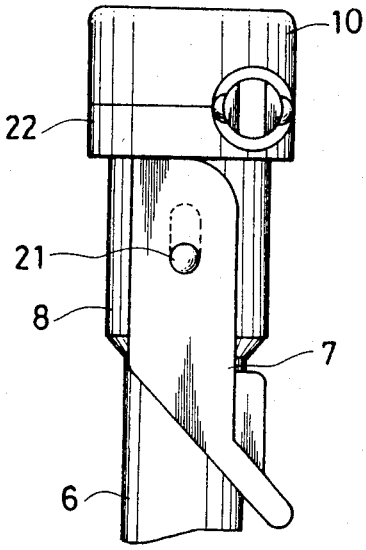
FIG. 38 is a view showing a state assumed by the locking lever 7 when the latter is turned from its first position shown in FIG. 27 to its second position.

As shown in FIGS. 27 and 38, the upper sleeve 8 has a bulging portion 22 capable of abutting against the locking lever 7. Therefore, if the locking lever 7 is turned from the first position shown in FIG. 27 to the second position shown in FIG. 38, the upper sleeve 8 is pushed up for upward displacement by the locking lever 7. Since the upper engaging member 10 is placed on the upper sleeve 8, it is also displaced upward along with the upward displacement of the upper sleeve 8.

Figure 30:
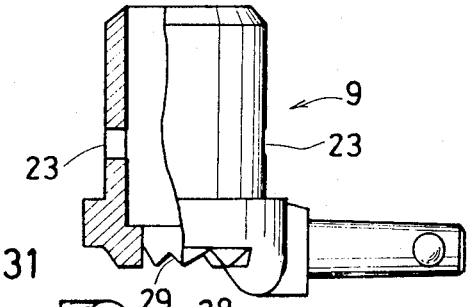
Figure 31:
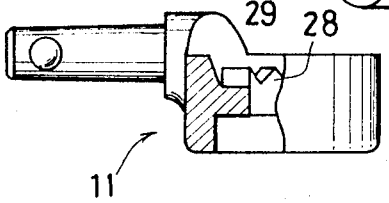

Referring to FIGS. 26, 30 and 34, the lower sleeve 9 is formed with round holes 23 and, correspondingly thereto, the lower end portion of the vertical pipe 6 is formed with round holes 24. The lower sleeve 9 is attached to the vertical pipe 6 by a lower pin 25 extending through said round holes 23 and 24.

Referring to FIGS. 7 and 8 the contact portions of the upper engaging member 10 and upper sleeves 8 are formed with engaging raised and recessed portions 26 and 27, respectively, which are engageable with each other. The engaging raised and recessed portions 26 and 27 are in the form of a plurality of V-shaped ridges interconnected in annular form. In the state shown in FIGS. 26 and 27, the engaging raised and recessed portions 26 and 27 are engaged with each other. In this state, if torque is imparted to the upper engaging member 10, the engaging raised portions are moved on the inclined surfaces of the engaging recessed portions 27 until they reach the position they are disengaged therefrom. In other words, the upper engaging member 10 is displaced upward at the same time as it is rotated, thus cancelling the engagement between the engaging raised and recessed portions 26 and 27. In this manner, relative turning movement between the upper engaging member 10 and the upper sleeve 8 is allowed.

Similarly, the contact portions of the lower engaging member 11 and lower sleeve 9 are formed with engaging raised and recessed portions 28 and 29, respectively, which are engageable with each other. Since the action of the engaging raised and recessed portions 28 and 29 is the same as that of the engaging raised and recessed portions 26 and 27, a description thereof is omitted.

Figure 36:
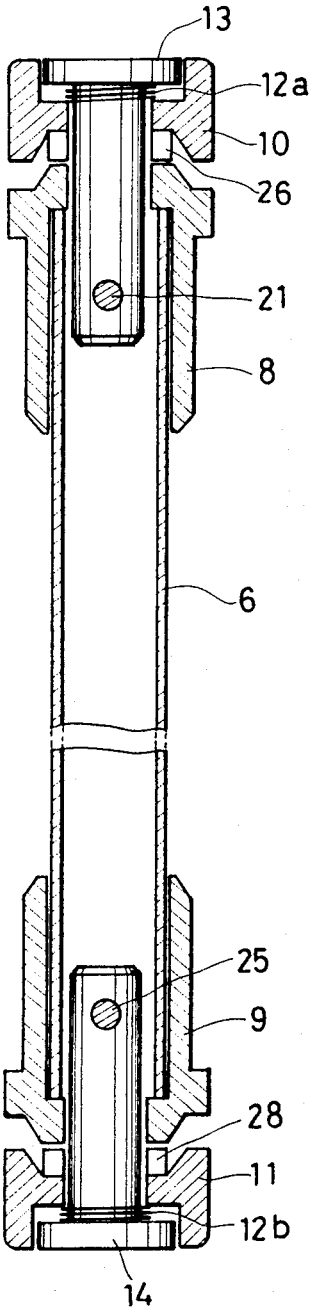
FIG. 36 is a sectional view showing the upper engaging member 10 and upper sleeve 8 disengaged from each other and the lower engaging member 11 and lower sleeve 9 disengaged from each other.

As shown in FIG. 27, when the locking lever 7 is in the first position, relative turning movement between the first and second panels 2a and 2b is allowed. For example, suppose that rotative force is imparted to the second panel 2a. That is, suppose that rotative force is imparted to the upper and lower sleeves 8 and 9. Then, the upper engaging member 10 is displaced upward against the force of the spring 12a. Further, the lower engaging member 11 is also displaced downward against the force of the spring 12b. As a result, the engagement between the upper engaging member 10 and the upper sleeve 8 and between the lower engaging member 11 and the lower sleeve 9 is cancelled. This state is shown in FIG. 36. In this manner, the first panel 2a can be turned to a desired position.

Figure 39:
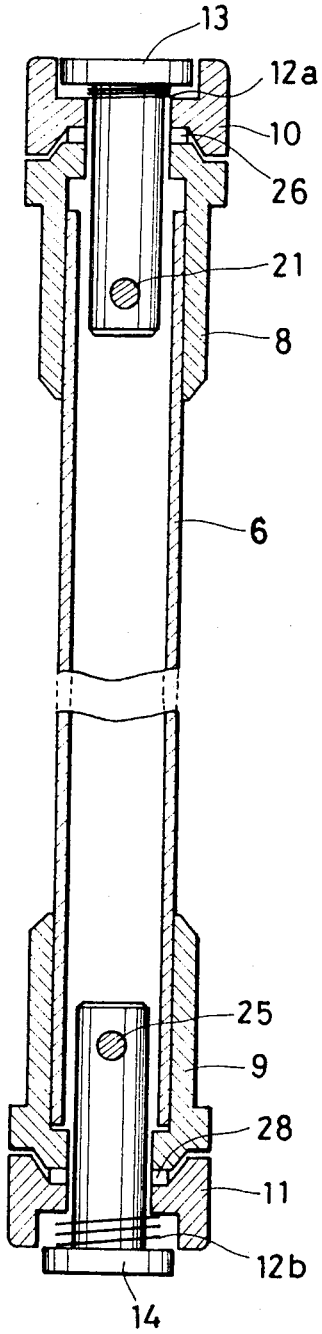
FIG. 39 is a sectional view showing a state established by turning the locking lever 7 from the state shown in FIG. 26 to its second position.
Figure 37:
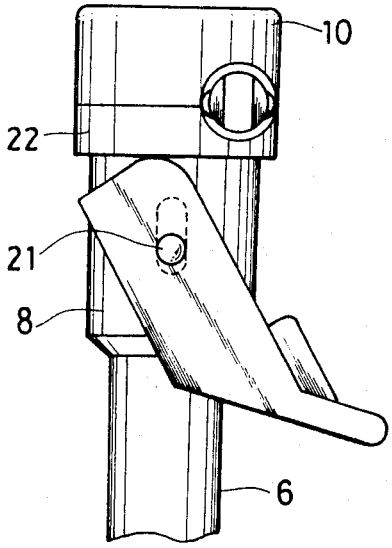
FIG. 37 is a view showing an intermediate state assumed by the locking lever 7 when the latter is turned from the state shown in FIG. 27.

Consideration will now be given to the case where after the first panel 2a has been turned to a desired position, it is desired to fix it in that state. Before it is fixed, the state is as shown in FIGS. 26 and 27. From this state, the locking lever 7 is turned to the second position shown in FIG. 38. FIG. 37 shows an intermediate state assumed by the locking lever 7 during its turning movement. With the turning movement of the locking lever 7, the upper sleeve 8 and upper engaging member 10 are pushed up for upward displacement by the locking lever 7. Finally, the state shown in FIG. 39 is established. In the state shown in FIG. 39, no further upward movement is allowed because of the presence of the flange portion of the upper flange and the spring 12a. In this manner, the upper engaging member 10 and the upper sleeve 8 are sandwiched between the upper flange member 13 and the locking lever 7, so that their engagement cannot be cancelled. Further, the engagement between the lower engaging member 11 and the lower sleeve 9 is maintained by the action of the spring 12b.

As is clear from the description given above, when the locking lever 7 is in the second position shown in FIGS. 25 and 38, relative turning movement between the first and second panels 2a and 2b is reliably inhibited.

On the other hand, if the locking lever 7 is turned to the first position shown in FIG. 27, the first and second panels 2a and 2b can be easily turned with less force.

Figure 40:
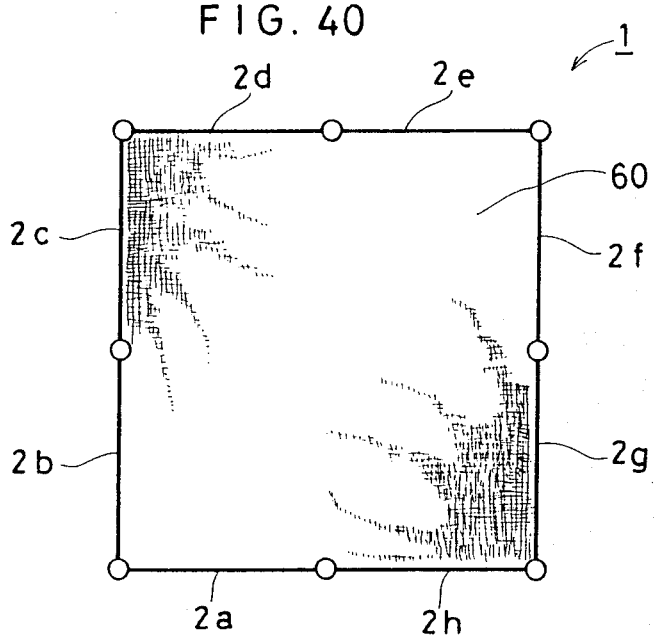
FIG. 40 is a schematic view, taken from above, of a playpen 1 having a mattress.
Figure 41:
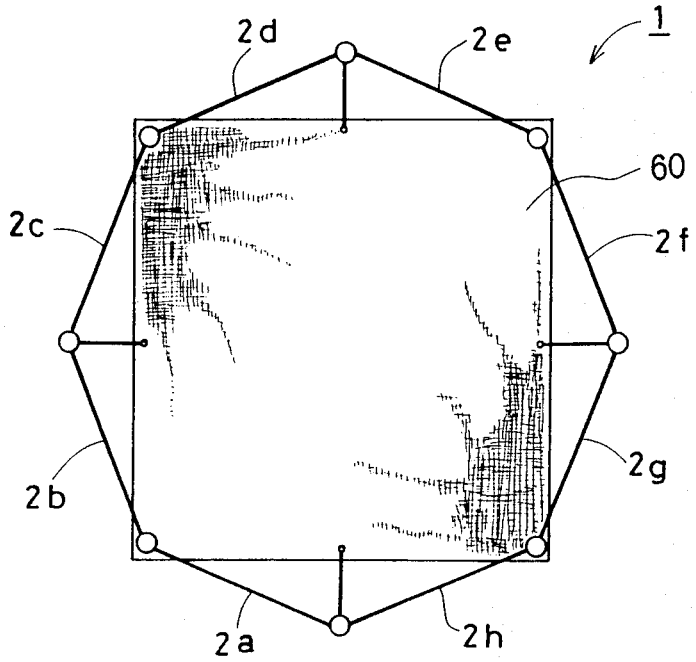
FIG. 41 is a view showing a state established by changing the enclosure provided by the playpen 1 from the state shown in FIG. 40.

Preferably, the playpen 1 is provided with a mattress. FIG. 40 is a schematic view, taken from above, of such a playpen 1. The mattress 60 is, for example, square, and is attached to the bottoms of the panels 2a, 2b . . . 2h as by strings. In FIG. 40, the shape of the enclosure provided by the playpen 1 substantially coincides with that of the mattress 60. However, in the state shown in FIG. 41, the shape of the enclosure provided by the playpen is changed to an octagonal one, with the result that it does not coincide with the shape of the mattress 60. Even in the state shown in FIG. 41, however the mattress 60 is firmly attached to the bottom of the playpen 1 as by strings. If the playpen 1 has a mattress 60 as in this case, when the playpen 1 is used outdoors, it is possible to protect the body of the child from being contaminated with soil or mud. Further, since the mattress is loaded with the child, the danger of the playpen being toppled is eliminated, a fact which is desirable from the standpoint of safety.

In addition, it is to be noted that the illustrated embodiments are examples only. Thus, various modifications and changes are possible within the scope of the invention. For example, while springs 12a and 12b have been installed between the upper engaging member 10 and the upper flange member 13 and between the lower engaging member 11 and the lower flange member 14 in the embodiment shown in FIG. 26, such springs 12a and 12b can be omitted. In that case, round holes 23 and 24 shown in FIGS. 30 and 34 would be changed to vertically extending elongated openings.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A playpen having a plurality of panels for enclosing a given space, adjacent panels being turnably connected together, said playpen comprising:

a vertical pipe vertically extending along the boundary line between first and second panels disposed at predetermined positions, an upper sleeve fixed to the upper end of the first panel and receiving the upper end of said vertical pipe, a lower sleeve fixed to the lower end of the first panel and receiving the lower end of said vertical pipe, vertically extending elongated openings formed in said upper sleeve, an upper pin extending through said vertical pipe and said elongated openings in said upper sleeve so that its opposite ends project beyond the outer surface of said vertical pipe, a locking lever attached to the projecting portions of said pin so that it is turnable around the axis of said pin between a first position and a second position, a lower pin which interconnects said vertical pipe and said lower sleeve so that they are rotatable in a unit, said upper sleeve being displaced downward along said vertical pipe when said locking lever is in said first position, said upper sleeve being pushed up for upward displacement along said vertical pipe by said locking lever when the latter is in said second position, an upper engaging member fixed to the upper end of the second panel and disposed above said upper sleeve, a lower engaging member fixed to the second panel and disposed below said lower sleeve, a distance defining member for defining the maximum distance by which said upper and lower engaging members can be separated from each other, the contact portions of said upper engaging member and said upper sleeve and the contact portions of said lower engaging member and said lower sleeve being formed with engaging raised and recessed portions, respectively, which are engageable with each other, the arrangement being such that when said locking lever is in said first position, said upper engaging member and said upper sleeve on the one hand and said lower engaging member and said lower sleeve on the other hand can be moved away from each other to the position where the engagement between said engaging raised and recessed portion is cancelled, thus allowing relative turning movement between the first and second panels, and when said locking lever is in said second position, said upper and lower engaging members having the distance therebetween defined by said distance defining member are in close contact with said upper and lower sleeves, respectively, so that the engagement between said engaging raised and recessed portions is maintained, thus inhibiting relative turning movement between the first and second panels.

2. A playpen as set forth in claim 1, wherein said distance defining member comprises a rod vertically extending inside said vertical pipe, an upper flange member fixed to the upper end of said rod and capable of abutting against the upper surface of said upper sleeve, and a lower flange member fixed to the lower end of said rod and capable of abutting against the lower surface of said lower sleeve.

3. A playpen as set forth in claim 1, including a mattress disposed at the bottom of said playpen.

4. A playpen having a plurality of panels for enclosing a given space, adjacent panels being turnably connected together, said playpen comprising:

a vertical pipe vertically extending along the boundary line between first and second panels disposed at predetermined positions, an upper sleeve fixed to the upper end of the first panel and receiving the upper end of said vertical pipe, a lower sleeve fixed to the lower end of the first panel and receiving the lower end of said vertical pipe, vertically extending elongated openings formed in said upper sleeve, an upper pin extending through said vertical pipe and said elongated openings in said upper sleeve so that its opposite ends project beyond the outer surface of said vertical pipe, a locking lever attached to the projecting portions of said pin so that it is turnable around the axis of said pin between a first position and a second position, a lower pin which interconnects said vertical pipe and said lower sleeve so that they are rotatable in a unit, said upper sleeve being dispaced downward along said vertical pipe when said locking lever is in said first position, said upper sleeve being pushed up for upward displacement along said vertical pipe by said locking lever when the latter is in said second position, an upper engaging member fixed to the upper end of the second panel and disposed above said upper sleeve, a lower engaging member fixed to the second panel and disposed below said lower sleeve, an upper flange member which has a flange portion positioned above said upper engaging member and which is fixedly attached to the upper end of said vertical pipe, a lower flange member which has a flange portion positioned below said lower engaging member and which is attached to the lower end of said vertical pipe, the contact portions of said upper engaging member and said upper sleeve and the contact portions of said lower engaging member and said lower sleeve being formed with engaging raised and recessed portions, respectively, which are engageable with each other, the arrangement being such that when said locking lever is in said first position, said upper engaging member and said upper sleeve on the one hand and said lower engaging member and said lower sleeve on the other hand can be moved away from each other to the position where the engagement between said engaging raised and recessed portions is cancelled, thus allowing relative turning movement between the first and second panels, and when said locking lever is in said second position, said upper engaging member is in close contact with said upper sleeve, so that the engagement between said engaging raised and recessed portions is maintained, thus inhibiting relative turning movement between the first and second panels.

5. A playpen as set forth in claim 4, including a mattress disposed at the bottom of said playpen.

* * * * *